US006279301B1

(12) United States Patent
Corniani et al.

(10) Patent No.: US 6,279,301 B1
(45) Date of Patent: Aug. 28, 2001

(54) METHOD AND MACHINE FOR PACKING A PRODUCT

(75) Inventors: Carlo Corniani, Marmirolo; Roberto Risi, Casalecchio Di Reno; Attilio Maggi, Ponti Sul Mincio, all of (IT)

(73) Assignee: Azionaria Costruzioni Macchine, Bologna (IT)

( * ) Notice: Subject to any disclaimer, the term of this patent is extended or adjusted under 35 U.S.C. 154(b) by 0 days.

(21) Appl. No.: 09/416,621

(22) Filed: Oct. 12, 1999

(30) Foreign Application Priority Data

Oct. 13, 1998 (IT) ..... BO98A0575

(51) Int. Cl.[7] ..... B65B 3/02; B65B 21/24

(52) U.S. Cl. ..... 53/458; 53/48.7; 53/48.9; 53/491; 493/80

(58) Field of Search ..... 53/458, 462, 491, 53/48.1, 48.7, 48.9, 49.9; 493/80

(56) References Cited

U.S. PATENT DOCUMENTS

| | | | | |
|---|---|---|---|---|
| 3,332,207 | | 7/1967 | Midnight | 53/207 |
| 3,516,219 | | 6/1970 | Nigrelli et al. | 53/48 |
| 3,766,704 | * | 10/1973 | Ganz | 53/48 |
| 4,589,862 | * | 5/1986 | Murrah | 493/183 |
| 5,148,654 | | 9/1992 | Kisters | 53/462 |
| 5,359,830 | * | 11/1994 | Olson et al. | 53/398 |
| 5,666,789 | * | 9/1997 | Ziegler | 53/447 |
| 5,671,587 | * | 9/1997 | Robinson | 53/398 |
| 5,677,055 | | 10/1997 | Ohkawachi et al. . | |
| 5,692,361 | * | 12/1997 | Ziegler et al. | 53/447 |
| 5,727,365 | * | 3/1998 | Lashyro et al. | 53/448 |
| 5,826,408 | * | 10/1998 | Ford | 53/491 |
| 5,850,725 | * | 12/1998 | Chalendar | 53/566 |
| 6,038,831 | * | 3/2000 | Nava | 53/207 |

FOREIGN PATENT DOCUMENTS 4018140 9/1991 (DE) .

OTHER PUBLICATIONS

Derwent Abstract of De 4018140 Dated Sep. 26, 1991.

* cited by examiner

*Primary Examiner*—Peter Vo
*Assistant Examiner*—Christopher Harmon
(74) *Attorney, Agent, or Firm*—Ladas & Parry

(57) ABSTRACT

A method and machine for packing a product by means of a flat blank having a central portion supporting the product and in turn having first lateral wings, and two opposite lateral portions, each having second lateral wings; the method and machine provide for folding the first lateral wings using at least one folding body, which has a first and a second folding edge differently inclined with respect to each other, and is rotated about an axis of rotation so that the first folding edge folds a respective first lateral wing to a given angle of less than 90°, and the second folding edge folds corresponding second lateral wings to an angle of 90°; the folding body is then rotated further about the axis of rotation so that the first folding edge completes the folding of the first lateral wing to 90°.

12 Claims, 8 Drawing Sheets

1
2
4
6
7
8
18
19
20
29
30
31
32
33
34
35
36
37
41
42
43
44
45
46
47
48
49
67
P1
P2
S1
S2
S6

29
50
52
S2
61b
23a
22
7
8
20
24
S3
23b
73
A
26
22
S4
74
23a
1
25
28
51
75
27
S5
8
75
55
60
61a
52
53
62

37
18
P2
36
70
S1
19
72
8
30
67
2
29
P1
33
33
4
40
71
S2
22
70
69
68
23a
20
7

METHOD AND MACHINE FOR PACKING A PRODUCT

The present invention relates to a method of packing a product.

The present invention may be used to advantage on bottle cartoning machines, to which the following description refers purely by way of example.

BACKGROUND OF THE INVENTION

On known machines for cartoning groups of bottles, such as the type described, for example, in U.S. Pat. No. 5,148,654, a group of bottles is fed along a packing path and eased onto a central portion of a flat cardboard blank, which is fed, parallel to the path, underneath and in time with the group. Once the group rests completely on the blank, the blank is folded against the group to define a package enclosing the group.

In addition to the central portion, the blank also comprises two first wings extending from the front and rear ends of the central portion; and two lateral portions adjacent to and on opposite sides of the central portion, and each having two second wings extending from the front and rear ends of the lateral portion. The blank is fed along the packing path with the central portion and the lateral portions aligned with one another before being folded crosswise to the packing path.

To fold the blank, two folding bodies are fed along the packing path in time with the assembly defined by the blank and the product and respectively in front of and behind the assembly in the traveling direction along the packing path.

Each folding body comprises a first and a second differently inclined folding edge, and is rotated about an axis crosswise to the packing path so that the first folding edge folds a respective first wing through a given angle of less than 90°, and the second folding edge folds respective second wings through 90°.

As the assembly is fed along the packing path, the two lateral portions are then engaged by fixed folding edges and folded 90° onto the product and with respect to the central portion; and, once the two lateral portions are folded, the fixed folding bodies release the assembly, which is then engaged by spring-activated retaining edges for keeping the first wings folded at said given angle with respect to the central portion of the blank. In this position, the first wings are gummed and then finish-folded to 90° against the product so that the respective assembly contacts the previous assembly and, later, the next assembly.

The spring-activated retaining edges are particularly complex and, therefore, expensive, and do not always ensure correct positioning of the first wings, particularly at the high traveling speeds of the assemblies on modern bottle cartoning machines capable of producing up to 100 packages a minute.

Moreover, when released by the folding bodies, the assembly is no longer effectively retained at the front and rear, so that, as a result of inevitable vibration induced as it travels at relatively high speed along the packing path, the group of bottles is subjected to severe mechanical stress.

SUMMARY OF THE INVENTION

It is an object of the present invention to-provide a method of packing a product, designed to eliminate the aforementioned drawbacks and which, at the same time, is cheap and easy to implement.

According to the present invention, there is provided a method of packing a product by means of a flat blank comprising a central portion having first lateral wings; and two opposite lateral portions, each having second lateral wings; the method comprising the steps of resting the product on said central portion to define an assembly defined by the product and the blank; feeding said assembly along a packing path with said central portion and said lateral portions aligned with one another in a direction crosswise to the packing path; feeding along said packing path, and in time with said assembly, at least one folding body having a first and a second folding edge differently inclined with respect to each other; effecting a first rotation of said folding body about an axis crosswise to said packing path so that the first folding edge folds a respective said first lateral wing to a given first angle of less than 90°, and the second folding edge simultaneously folds respective second lateral wings through 90°; folding said lateral portions through 90° onto the product; and completing 90° folding of said first lateral wing against the product and at least partly onto said second lateral wings; the method being characterized in that said step of completing 90° folding of the first lateral wing is performed by effecting a further second rotation of said folding body about said axis.

The present invention also relates to a machine for packing a product.

According to the present invention, there is provided a machine for packing a product by means of a flat blank comprising a central portion having first lateral wings; and two opposite lateral portions, each having second lateral wings; the machine comprising a forming unit for resting said product on said central portion to define an assembly defined by the product and the blank; a first conveyor for feeding said assembly along a packing path with said central portion and said lateral portions aligned with one another in a direction crosswise to the packing path; at least one second conveyor for feeding along said packing path, and in time with said assembly, at least one folding body having a first and a second folding edge differently inclined with respect to each other; folding means for folding said lateral portions through 90° onto the product; and control means for rotating said folding body about an axis crosswise to said packing path; the machine being characterized in that said control means are such as to successively effect a first and a second rotation of said folding body about said axis.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
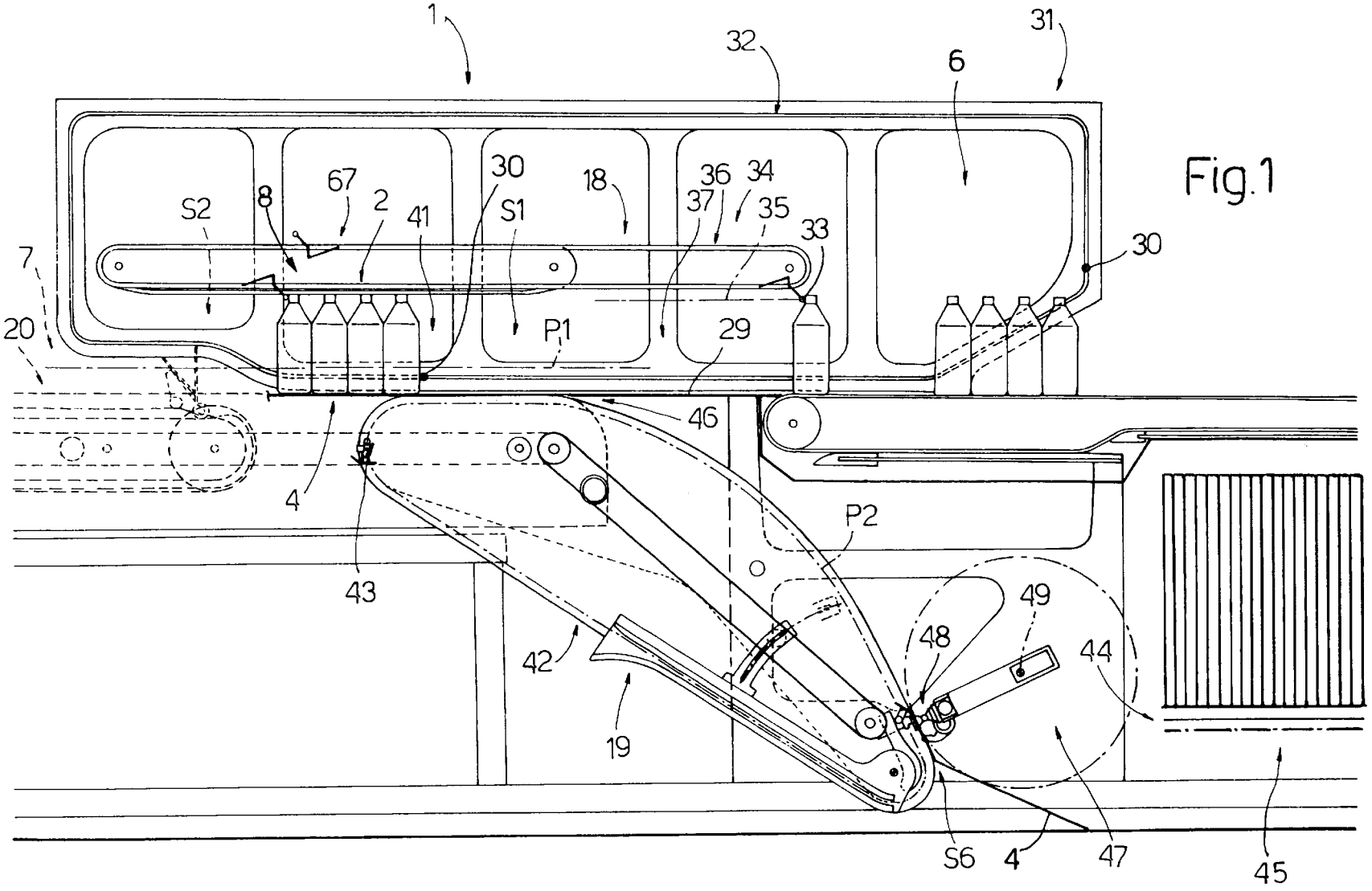
FIG. 1 shows a schematic, partially sectioned side view, with parts removed for clarity, of an input section of a preferred embodiment of the machine according to the present invention.
Figure 10:
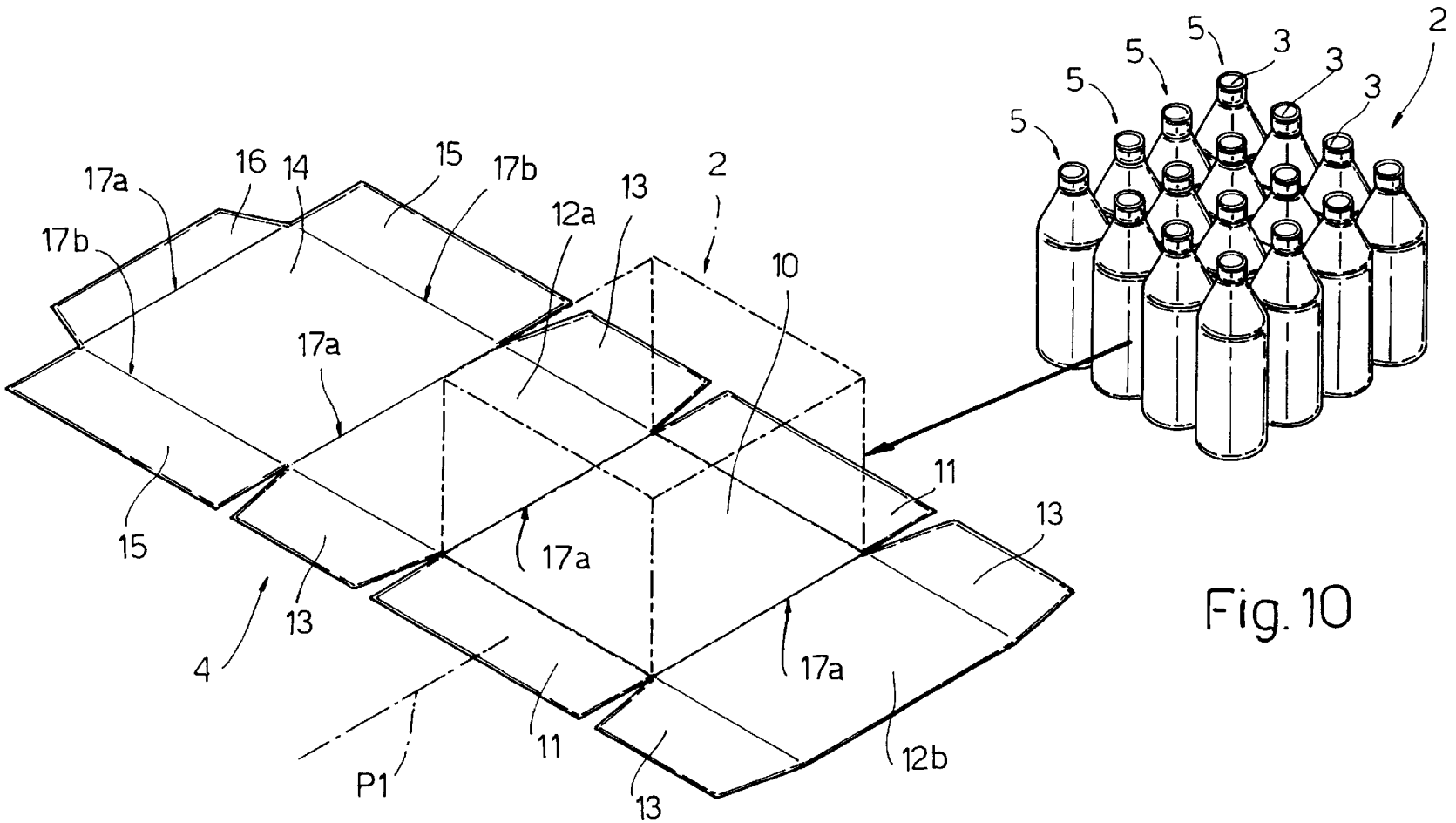
FIG. 10 shows a view in perspective of a blank and a product processed on the FIG. 1 machine.

Number 1 in FIG. 1 indicates as a whole a cartoning machine for packing groups 2 of bottles 3 in respective flat cardboard blanks 4. As shown in FIG. 10, each group 2 is defined by a given N number of bottles 3 arranged in a number of side by side rows 5. In the example embodiment shown in the accompanying drawings, each group 2 is defined by sixteen bottles 3 arranged in four rows 5 of four bottles 3 each.

Figure 11:
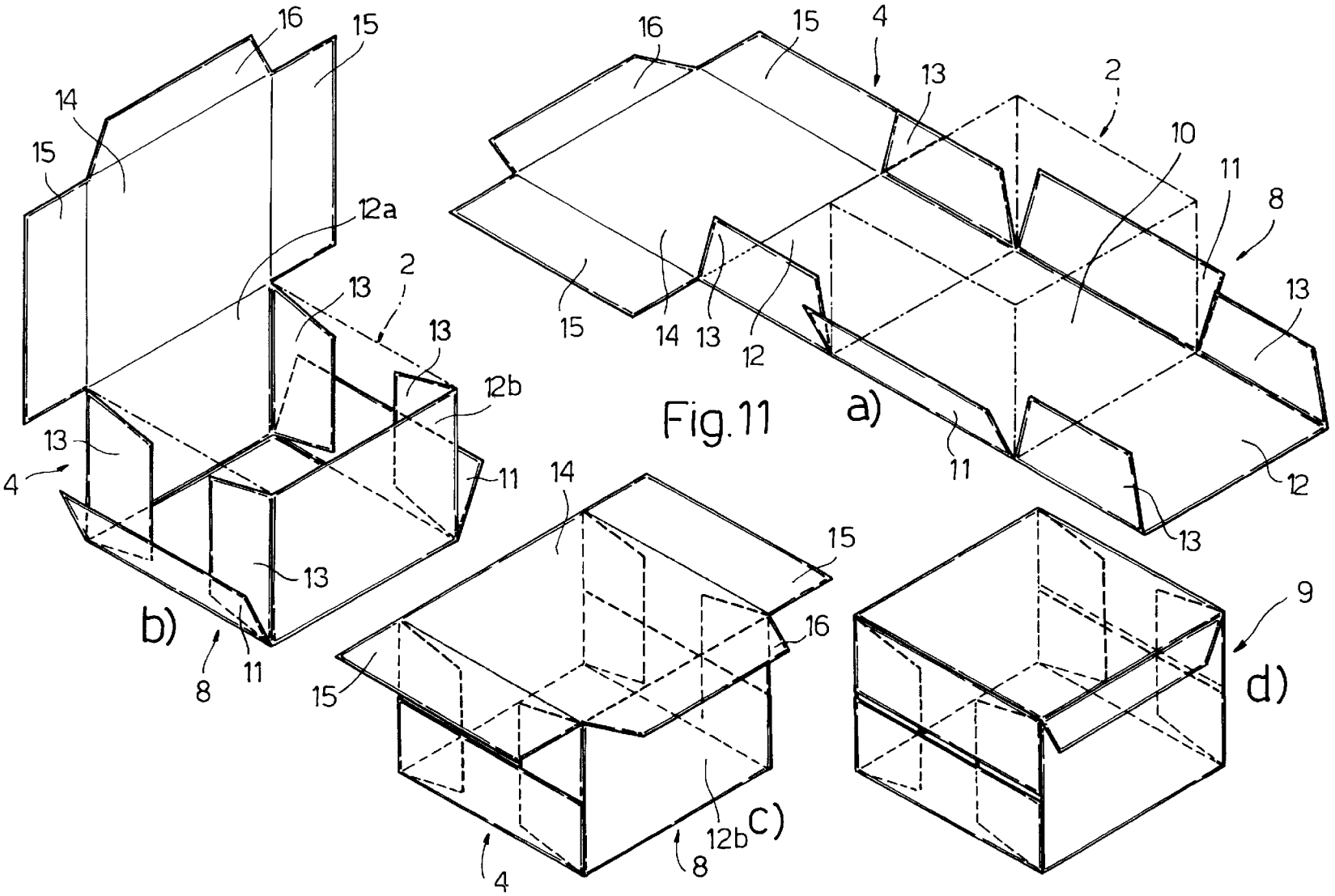
FIG. 11*a–d* show in perspective, successive stages in the folding of the FIG. 10 blank by the FIG. 1 machine.

As shown in FIG. 1, cartoning machine 1 comprises an input portion having a known group forming unit 6 (shown partly and, for example, of the type described in U.S. Pat. No. 5,667,055) which receives bottles 3 from a known filling machine (not shown) to form groups 2 which are subsequently fed to a packing unit 7 (shown more clearly in FIG. 2) where each group 2 is brought into contact with a respective blank 4 to form an assembly 8. Subsequently, each assembly 8 is fed along a packing path P1, along which respective blank 4 is folded about respective group 2 to form a finished carton 9 (shown in FIG. 11*d*).

As shown in FIG. 10, each blank 4 comprises a central portion 10 with lateral wings 11; and two opposite lateral portions 12, which are indicated 12*a* and 12*b*, are located on opposite sides of central portion 10, and each comprise respective lateral wings 13. Lateral portion 12*a* is located in an intermediate position between central portion 10 and a further portion 14, which is substantially identical to central portion 10 and comprises lateral wings 15 and a central tongue 16.

Portions 10, 12 and 14, wings 11, 13 and 15, and tongue 16 are connected to one another along preformed bend lines 17*a* and 17*b*, which are respectively parallel and perpendicular to packing path P1.

Figure 3:
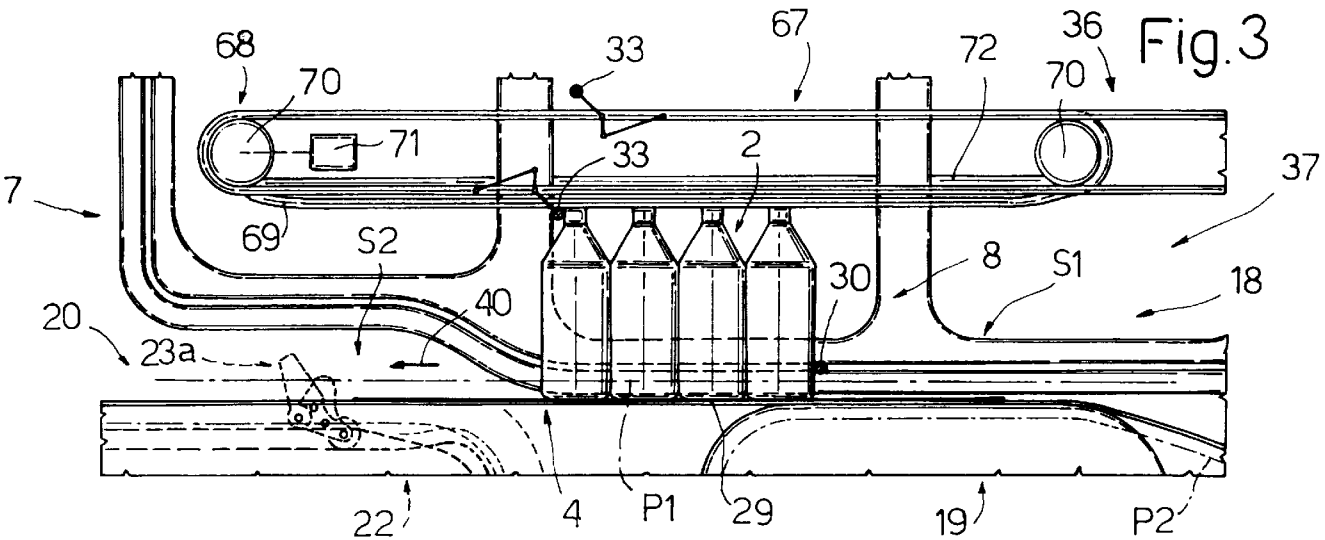
FIG. 3 shows a larger-scale side view of a detail in FIG. 1.
Figure 4:
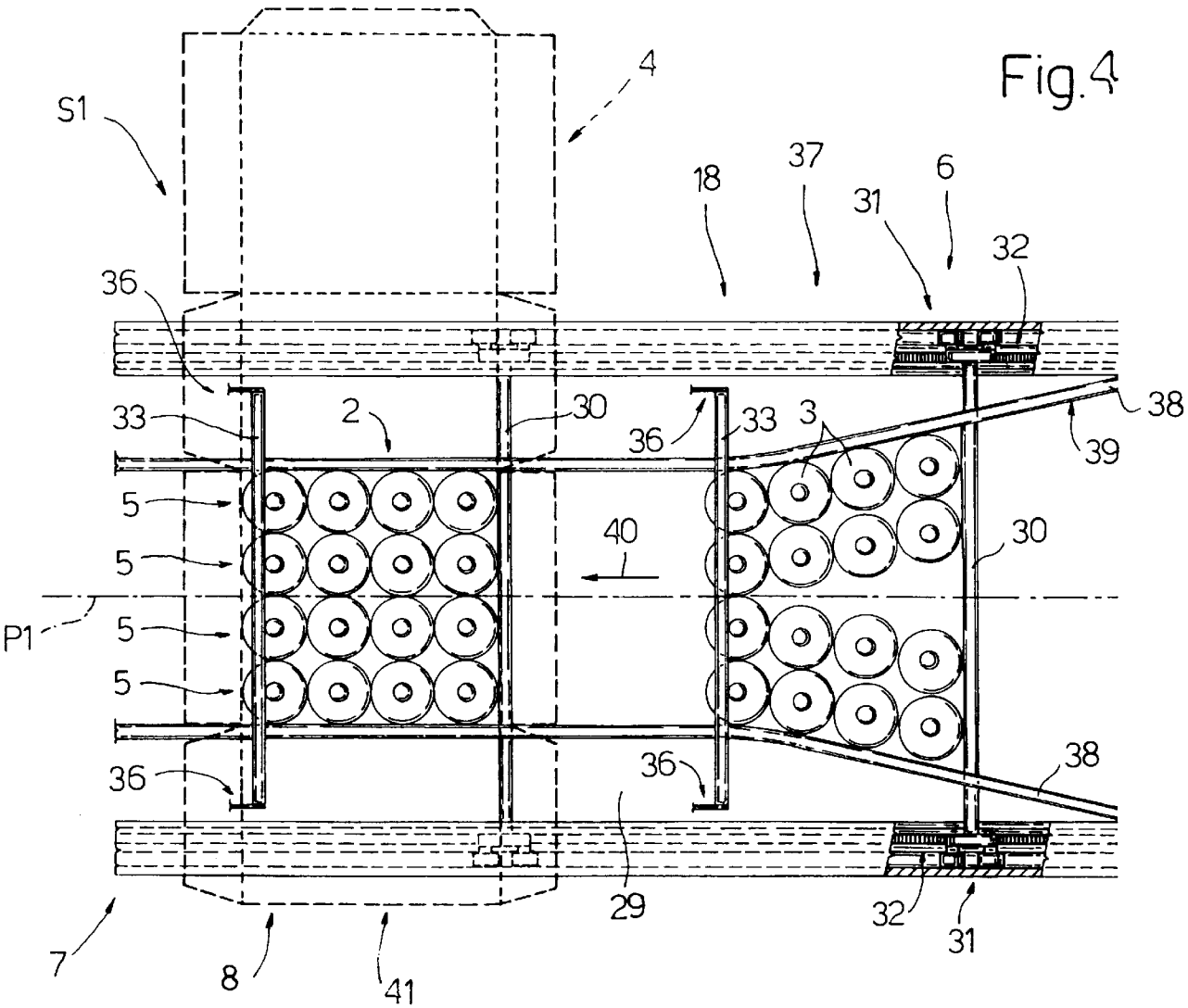
FIGS. 4 and 5 show larger-scale plan views, with parts removed for clarity, of two different details of t h e FIG. 1 machine.

As shown in FIGS. 3 and 4, packing unit 7 comprises a conveyor 18 for feeding each group 2 at a constant speed V along packing path P1 and through a supply station S1 where a supply device 19 feeds a respective blank 4 underneath group 2 in time with group 2 and along a supply path P2 which joins up with packing path P1 at station S1, so as to ease group 2 onto central portion 10 of blank 4 and define a respective assembly 8.

Figure 2:
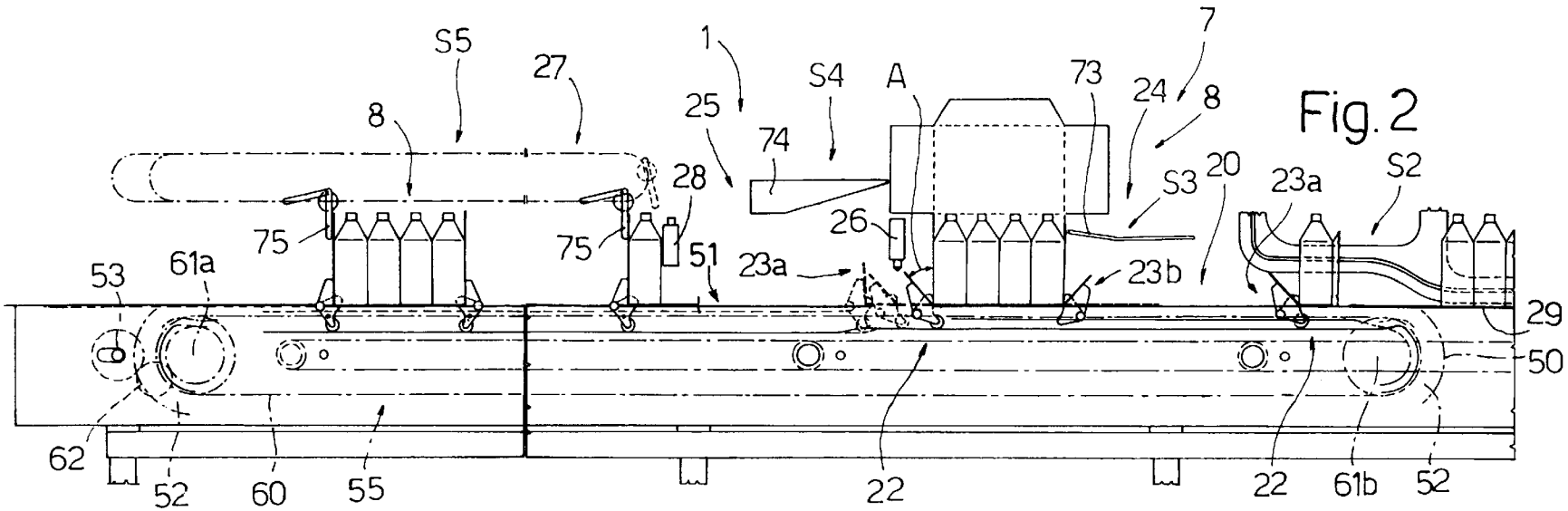
FIG. 2 shows a smaller-scale side view of an output section of the FIG. 1 machine.
Figure 5:
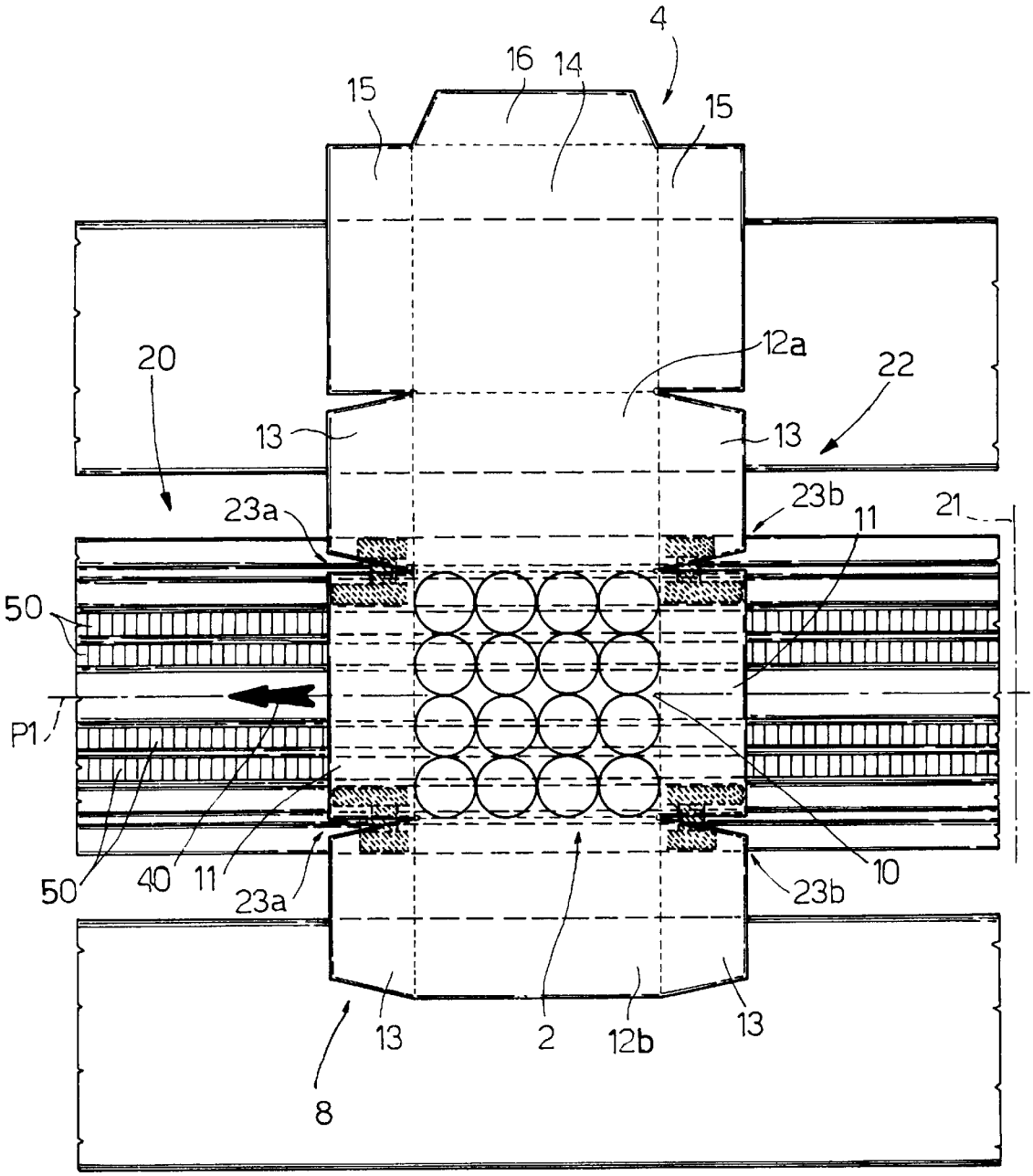

As shown in FIGS. 2 and 5, once formed, assembly 8 is fed onto a conveyor 20 and conveyed at speed V along a following portion of packing path P1 with respective central portion 10 and lateral portions 12 aligned in a direction 21 crosswise to packing path P1, and through an initial folding station S2 where a folding device 22 folds wings 13 at an angle of approximately but no more than 90°, and at the same time folds wings 11 at a given angle A with respect to wings 13. More specifically, lateral wings 11 are folded along respective peripheral bend lines 17*b* of central portion 10.

Folding device 22 comprises a number of pairs of folding bodies 23, each of which pairs is fed from station S2 along packing path P1 and in time with a respective assembly 8 to engage assembly 8 at the front and rear in the traveling direction along path P1. In particular, a respective first pair of folding bodies 23—indicated 23*a* in the accompanying drawings—engages assembly 8 at the front, and a respective second pair of folding bodies 23—indicated 23*b* in the accompanying drawings—engages assembly 8 at the rear.

Conveyor 20 then feeds assembly 8 through a folding station S3 where a fixed folding device 24 folds lateral portions 12 through 90° onto group 2; and through a following folding station S4 where folding device 22 completes 90° folding of wings 11 onto group 2 and onto respective bottom portions of wings 13, while a fixed folding device 25 folds portion 14 through 90° onto group 2, and then folds tongue 16 through 90° onto group 2 and onto a corresponding lateral portion 12*b*.

Along an initial portion of folding station S4, a known gumming device 26 is provided for depositing gum onto the surfaces of wings 11 to be brought into contact with wings 13 so as to enable wings 11 to adhere to wings 13, and for depositing gum onto the surface of tongue 16 to be brought into contact with respective lateral portion 12*b* so as to enable tongue 16 to adhere to lateral portion 12*b*.

Conveyor 20 then feeds assembly 8 through a final folding station S5 where a movable folding device 27 folds wings 15 through 90° onto group 2 and onto respective top portions of wings 13. Along an initial portion of folding station S5, a known gumming device 28 is provided for depositing gum onto the surfaces of wings 15 to be brought into contact with wings 13 so as to enable wings 15 to adhere to wings 13.

As shown in FIGS. 1, 3 and 4, conveyor 18 comprises a static surface 29, along which each group 2 is fed at speed V by a respective push bar 30, which engages group 2 from behind and extends crosswise to packing path P1.

Each bar 30 is advanced at speed V by a belt actuating device 31 having two endless guides 32 (only one shown in FIG. 1), which are positioned parallel and facing each other, extend on opposite sides of packing path P1, and engage in sliding manner respective opposite ends of bars 30.

Conveyor 18 also comprises a number of bars 33, each of which engages a respective group 2 at the front, and is fed by an actuating device 34 at speed V along a path 35 extending over static surface 29 and parallel to packing path P1. Actuating device 34 comprises a chain conveyor 36, which travels at speed V, supports bars 33, and extends over bottles 3 traveling along packing path P1.

Static surface 29 is shared by forming unit 6 and packing unit 7. In particular, along an initial portion 37 of surface 29, two fixed converging walls 38 define a channel 39 extending along surface 29 and having a section tapering in the traveling direction 40 of groups 2 along packing path P1. Channel 39 provides for compacting rows 5 in each group 2 fed by respective bar 30 along channel 39 in a direction crosswise to packing path P1.

As shown in FIG. 1, supply station S1 is located along a following portion 41 of static surface 29, where supply device 19 supplies blanks 4 by means of a conveyor 42 traveling at variable speed along supply path P2 and supporting a number of grippers 43, each of which engages a front end of a respective blank 4 to draw blank 4 along path P2.

Path P2 is an endless path and extends through a pickup station S6 located at the output 44 of a known store 45 for blanks 4, and through the following supply station S1 , which is located at the point 46 at which supply path P2 joins up with packing path P1.

Pickup station S6 comprises a pickup device 47 in turn comprising a suction pickup head 48, which is rotated at variable angular speed, about an axis 49 crosswise to path P2 and perpendicular to the FIG. 1 plane, to pick up a blank 4 from output 44 and feed blank 4 to conveyor 42.

As shown in FIGS. 2, 5 and 9*a–b*, conveyor 20 extends along packing path P1 from the end of static surface 29, and comprises four parallel, side by side chains 50 traveling at speed V and defining a movable supporting surface 51 for assemblies 8, the bottom surface of respective central portion 10 of each of which is gradually brought to rest on surface 51 as the assembly leaves static surface 29.

Chains 50 extend about two end gears 52, one of which, at the input end of conveyor 20, is located beneath static surface 29 and is rotated at constant angular speed by a motor 53 connected to the other gear 52. Surface 51 comprises a number of projections 54 (shown in FIG. 9) for engaging the bottom surface of central portion 10 of a respective blank 4 to prevent blank 4 from sliding with respect to surface 51.

Guides 32 of actuating device 31 and conveyor 36 of actuating device 34 also extend over an initial portion of conveyor 20 corresponding to folding station S2, to enable bars 30 and 33 to also engage respective groups 2 during the first fold of wings 11.

The folding bodies 23 in each pair of folding bodies 23 are aligned in direction 21; and each pair of folding bodies 23 is fed at speed V by a conveyor 55, extending parallel to conveyor 20, along packing path P1 and in time with a respective assembly 8. More specifically, a respective first pair of folding bodies 23*a* is conveyed so as to engage the front, in direction 40, of respective assembly 8, and a respective second pair of folding bodies 23*b* is conveyed so as to engage the rear, in direction 40, of respective assembly 8.

Figures 6, 7:
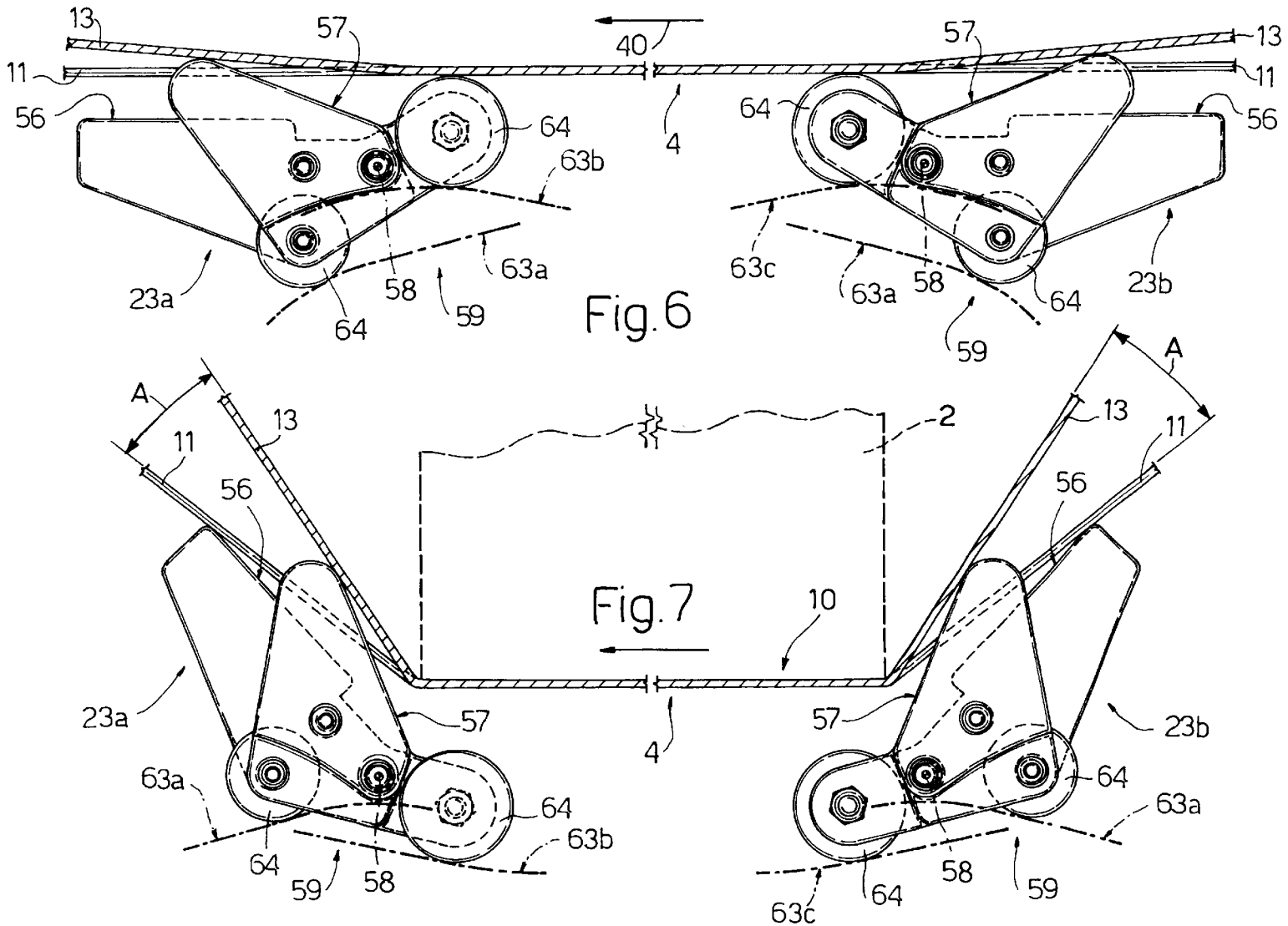
FIGS. 6, 7 and 8 show larger-scale side views of a device of the FIG. 1 machine in three different operating positions.
Figure 9:
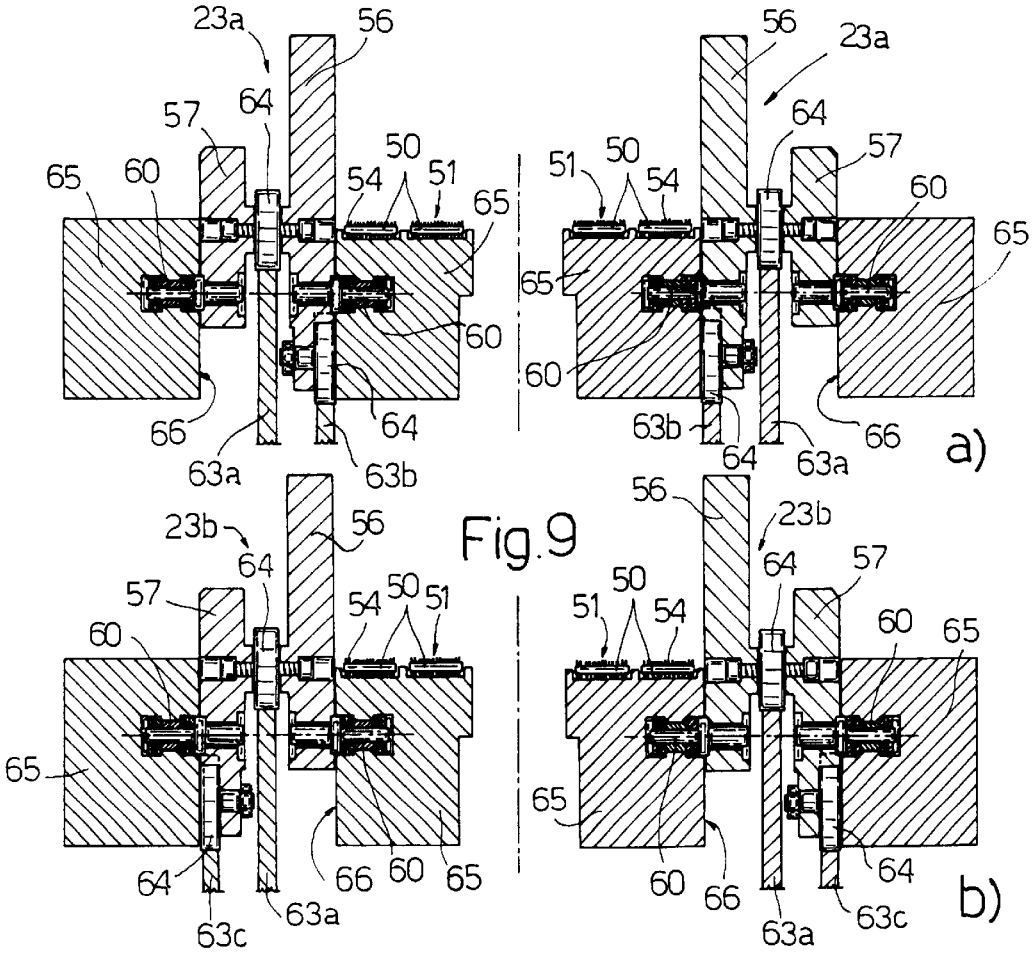
FIG. 9*a* and *b* show two front sections of the device in FIGS. 6, 7 and 8.
Figure 8:
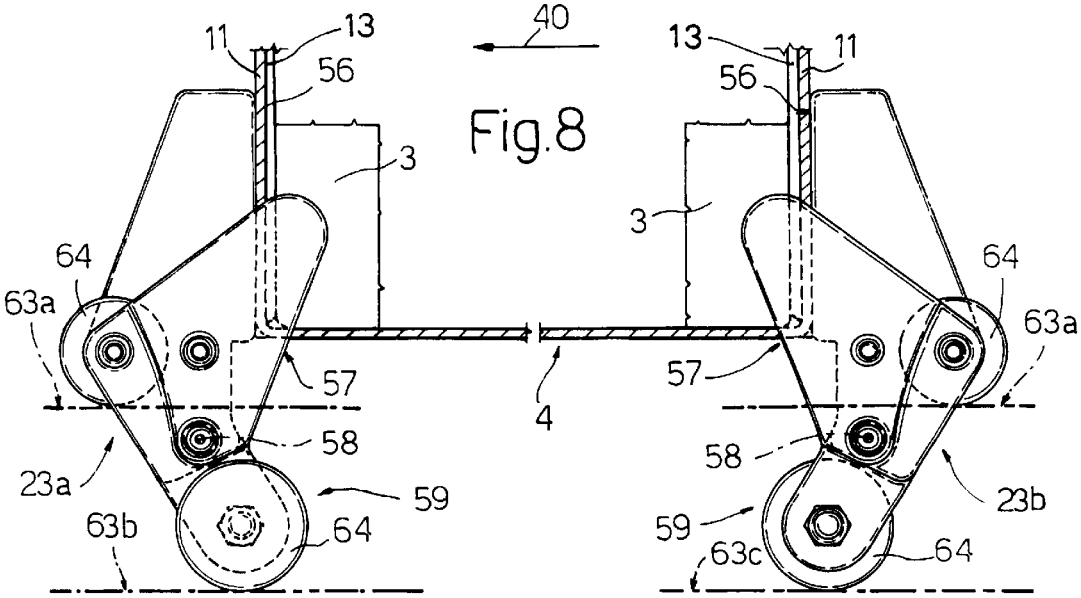

As shown in FIGS. 6, 7 and 8, each folding body 23 comprises two differently inclined folding edges 56 and 57, is hinged to conveyor 55 to oscillate, with respect to conveyor 55, about an axis 58 crosswise to path P1, and is connected to a control device 59 for controlling the angular position of body 23 about axis 58.

As shown in FIGS. 6, 7 and 8 folding edges 56 and 57 of each folding body 23 are so spaced in direction 21 that, in use, folding edge 56 faces a corresponding wing 11, and folding edge 57 faces a corresponding wing 13.

As shown in FIG. 7, each folding edge 57 slopes more steeply towards corresponding assembly 8 as compared with respective edge 56, so as to position wings 13 at an angle A with respect to wings 11 when, in use, both edges 57 and 56 act on respective wings 13 and 11.

As shown in FIGS. 9*a–b,* conveyor 55 comprises four parallel, side by side, coplanar chains 60 located at a lower level than chains 50. As shown in FIG. 2, each chain 60 extends about two end gears 61, one of which, indicated 61*a*, is located at the output end of conveyor 55 and is rotated at constant angular speed by a motor 62, and the other of which, indicated 61*b*, is located at folding station S2.

As shown in FIGS. 9*a–b,* control device 59 is a cam control device, and comprises three fixed cams 63 extending along packing path P1, and, for each folding body 23, a pair of tappet rollers 64, each of which is fitted in rotary manner to respective folding body 23, and is connected to a respective fixed cam 63 to positively control the angular position of respective folding body 23 about corresponding axis 58.

More specifically, a first tappet roller 64 of each folding body 23*a* is connected to a central cam 63*a*of the three cams 63; a second tappet roller 64 of each folding body 23*a* is connected to a lateral cam 63*b*of the three cams 63; a first tappet roller 64 of each folding body 23*b* is connected to the central cam 63*a*of the three cams 63; and a second tappet roller 64 of each folding body 23*b* is connected to a further lateral cam 63*c* of the three cams 63. The above connection of rollers 64 and cams 63 provides for controlling differently the oscillation of folding bodies 23*a* and the oscillation of folding bodies 23*b* about respective axes 58.

As shown in FIGS. 9*a–b* chains 60 and cams 63 are located at a lower level than chains 50; and fixed guard plates 65 extend along packing path P1, are interposed between chains 60 and the traveling surface of bottles 3 defined by conveying surface 51, and are spaced in direction 21 to define openings 66 parallel to path P1 and for enabling the passage of folding edges 56 and 57.

As shown in FIG. 3, a pressing device 67 is provided at folding station S2 to exert on group 2 a force F directed towards surface 51, and so keep group 2 pressed with a given pressure against central portion 10 of respective blank 4 as wings 11 are being folded by folding device 22.

Pressing device 67 comprises a conveyor 68 in turn comprising a belt 69, which is made of elastic material, travels at speed V, is located over packing path P1, and extends about two end pulleys 70, one of which is connected to a motor 71. A central portion of the bottom branch of belt 69 extends in contact with the bottom surface of a guide plate 72 by which the bottom surface of the bottom branch portion of belt 69 contacting the guide plate is maintained at a distance from surface 51 approximately equal to but no greater than the height of bottles 3. Plate 72 thus acts as a pressure member for holding bottles 3 of group 2 on blank 4 with said given force F.

As shown in FIG. 2, folding devices 24 and 25 are known fixed folding devices, and comprise respective fixed helical folding elements 73 and 74 located along packing path P1 to engage and fold respective portions of each blank 4 as blank 4 is fed along packing path P1.

Folding device 27 is known, and comprises two movable folding elements 75, each for engaging and folding a respective wing 15 as assembly 8 is fed along packing path P1.

Operation of machine 1 will now be described with reference to one group 2, and as of the instant in which group 2 is fed by a respective bar 30 along initial portion 37 of static surface 29.

As shown in FIG. 4, before being fed onto static surface 29, group 2 is engaged at the front and rear by bars 33 and 30 respectively; and bar 30 then feeds group 2 onto static surface 29 and, initially, along channel 39, which compacts rows 5 of group 2 crosswise to packing path P1. Group 2 is then fed through supply station S1 where a respective assembly 8 is formed by easing group 2 onto central portion 10 of a respective blank 4, which has been withdrawn from output 44 of store 45 by supply device 19, has been drawn along supply path P2, and is fed to station S1 beneath and in time with group 2. Blank 4 is withdrawn and supplied by supply device 19 so as to be positioned, with respect to packing path P1, with central portion 10 and lateral portions 12 aligned in direction 21.

As shown in FIG. 5, once formed, assembly 8 is fed onto conveyor 20 with the bottom surface of central portion 10 resting first on static surface 29 and then on supporting surface 51 defined by chains 50. As blank 4 comes to rest on surface 51, projections 54 of surface 51 engage the bottom surface of central portion 10 of blank 4 to prevent blank 4 from sliding with respect to surface 51.

As shown in FIGS. 1, 6 and 7, assembly 8 is then fed through folding station S2 where a respective pair of folding bodies 23*a* is fed along packing path P1 in time with assembly 8 to engage the front of assembly 8 as the front end of assembly 8 is fed through folding station S2 and therefore over gears 61*b*. Subsequently, a respective pair of folding bodies 23*b* is fed along packing path P1 in time with assembly 8 to engage the rear of assembly 8 as the rear end of assembly 8 is fed through folding station S2 and therefore over gears 61*b*.

Each folding body 23, as it travels upwards along the periphery of respective gear 61*b*, projects gradually above surface 51 and performs a first rotation about respective axis 58 to engage and gradually fold respective wings 11 and 13 into a position in which wings 13 form a substantially 90° angle with surface 51, and each wing 11 forms angle A with respective wings 13, and a 90° angle minus angle A with surface 51. More specifically, folding edges 56 fold lateral wings 11 along respective peripheral bend lines 17*b* of central portion 10, and folding edges 57 fold lateral wings 13 along respective peripheral bend lines 17*b* of corresponding lateral portions 12.

This first folding operation is performed at station S2 located beneath plate 72, i.e. is performed as plate 72 applies force F to press group 2 against central portion 10 of blank 4.

As assembly 8 is next fed through folding station S3, bars 30 and 33 release assembly 8, and control device 59 keeps folding bodies 23 in the position described above to retain assembly 8 at the front and rear as blank 4 is folded further.

As assembly 8 is fed through folding station S3, folding device 24 folds lateral portions 12 through 90° onto group 2; and, as assembly 8 is next fed through folding station S4, gumming device 26 deposits gum onto the surfaces of wings 11 to be brought into contact with wings 13 so as to enable wings 11 to adhere to wings 13, and deposits gum onto the surface of tongue 16 to be brought into contact with respective lateral portion 12*b* so as to enable tongue 16 to adhere to lateral portion 12*b*.

Once wings 11 and tongue 16 have been gummed by gumming device 26, fixed folding device 25 folds portion 14 through 90° onto group 2, and then folds tongue 16 through 90° onto group 2 and onto corresponding lateral portion 12*b*. At the same time, control device 59 imparts to each folding body 23 a second rotation, equal to angle A, about respective axis 58 to complete 90° folding of respective wing 11 onto group 2 and onto respective bottom portions of wings 13 (FIG. 8). The second rotation of folding bodies 23 obviously has no effect on wings 13, which have already been released by respective folding edges 57 following 90° folding of lateral portions 12.

As shown in FIGS. 6, 7 and 8, said first and second rotations of folding bodies 23 about respective axes 58 are effected in opposite directions, depending on whether the folding body 23 engages the assembly at the front (folding body 23*a*) or rear (folding body 23*b*).

Conveyor 20 then feeds assembly 8 through final folding station S5 where gumming device 28 deposits gum onto the surfaces of wings 15 to be brought into contact with wings 13 so as to enable wings 15 to adhere to wings 13; and folding device 27 then folds wings 15 through 90° onto group 2 and onto respective top portions of wings 13 to complete the formation of carton 9.

The above operations are repeated cyclically for successive assemblies 8.

In an alternative embodiment not shown, pressing device 67 also extends over a central portion of station S3 to apply force F to each group 2 as lateral portions 12 are being folded along respective peripheral bend lines 17*a* of central portion 10.

During the first folding operation to fold wings 11 of each assembly 8 along respective peripheral bend lines 17*b* of central portion 10, central portion 10 of blank 4 is therefore prevented from warping by being pressed by force F against surface 51, and, at the same time, group 2 is engaged at the front and rear by respective bars 33 and 30 to prevent substantially any movement of bottles 3 in group 2.

During the next folding operation to fold lateral portions 12 along respective peripheral bend lines 17*a* of central portion 10, assembly 8 is engaged at the front and rear by respective folding bodies 23, which prevent substantially any movement of bottles 3 in a direction parallel to packing path P1, and, at the same time, warping of central portion 10 crosswise to path P1 is substantially prevented by the previously folded wings 11, which act as strengthening ribs for transversely strengthening central portion 10.

The extremely fast operating speed of machine 1 may result in breakage of one or more bottles 3 in group 2 on conveyor 20. In the event of a bottle 3 breaking, guard plates 65 prevent the pieces of bottle 3 from dropping onto chains 60 or control device 59, and so ensure relatively long-term efficiency of chains 60 and control device 59.

As shown, conveyor 42 of supply device 19 feeds each blank 4 to supply station S1 by drawing blank 4 along path P2. This is preferable to pushing blank 4 along path P2, in that, once extracted from store 45, blank 4 may warp and would therefore require particularly extensive push members to ensure the blank is engaged and pushed correctly, and which would pose various problems of interference with conveyor 18 and groups 2 at station S1.

What is claimed is:

1. A method of packing a product by means of a flat blank (4) comprising a central portion (10) having first lateral wings (11); and two opposite lateral portions (12), each having second lateral wings (13); the method comprising the steps of resting the product (2) on said central portion (10) to define an assembly (8) defined by the product (2) and the blank (4); feeding said assembly (8) along a packing path (P1) with said central portion (10) and said lateral portions (12) aligned with one another in a direction (21) crosswise to the packing path (P1); feeding along said packing path (P1) and in time with said assembly (8), at least one folding body (23) having a first (56) and a second (57) folding edge differently inclined with respect to each other; effecting a first rotation of said folding body (23) about an axis (58) crosswise to said packing path (P1) so that the second folding edge (57) folds respective second lateral wings (13) substantially through 90°, and the first folding edge (56) simultaneously folds a respective said first lateral wing (11) to a given angle (A) with respect to the second lateral wings (13); folding said lateral portions (12) through 90° onto the product (2); and completing 90° folding of said first lateral wing (11) against the product (2) and at least partly onto said second lateral wings (13); the method being characterized in that said step of completing 90° folding of the first lateral wing (11) is performed by effecting a further second rotation of said folding body (23) about said axis (58).

2. A method as claimed in claim 1, characterized by comprising the further step of depositing gum between said first lateral wing (11) and said second lateral wings (13) to enable the first lateral wing (11) to adhere to the second lateral wings (13) once the first lateral wing (11) is folded completely.

3. A method as claimed in claim 1, characterized by feeding at least two said folding bodies (23*a*, 23*b*) along said packing path (P1) and in time with said assembly (8); said two folding bodies (23*a*, 23*b*) being respectively located at the front and rear of said assembly (8) in a traveling direction (40) along said packing path (P1); and each of said two folding bodies (23*a*, 23*b*) folding at least a respective second lateral wing (13) and a respective first lateral wing (11).

4. A machine for packing a product by means of a flat blank (4) comprising a central portion (10) having first lateral wings (11); and two opposite lateral portions (12), each having second lateral wings (13); the machine (1) comprising forming means (18, 19) for resting said product (2) on said central portion (10) to define an assembly (8) defined by the product (2) and the blank (4); a first conveyor (20) for feeding said assembly (8) along a packing path (P1) with said central portion (10) and said lateral portions (12) aligned with one another in a direction (21) crosswise to the packing path (P1); at least one second conveyor (55) for feeding along said packing path (P1), and in time with said assembly (8), at least one folding body (23) having a first (56) and a second (57) folding edge differently inclined with respect to each other; folding means (24) for folding said lateral portions (12) through 90° onto the product (2); and control means (59) for rotating said folding body (23) about an axis (58) crosswise to said packing path (P1); said control means (59) being such as to successively effect a first and a second rotation of said folding body (23) about said axis (58) wherein, during the first rotation, the second folding edge (57) folds said second lateral wings (13) substantially through 90°, and the first folding edge (56) folds said first lateral wing (11) to a given angle (A) with respect to the second lateral wings (13); and wherein, during said second rotation, the first folding edge (56) completes 90° folding of the first lateral wing (11).

5. A machine as claimed in claim 4, characterized in that said first conveyor (20) comprises a movable conveying surface (51) supporting said assembly (8).

6. A machine as claimed in claim 5, characterized in that said surface (51) comprises a number of projections (54) for engaging a bottom surface of said blank (4) to prevent the blank (4) from sliding with respect to said surface (51).

7. A machine as claimed in claim 4, characterized in that said folding body (23) is hinged to said second conveyor (55) to oscillate about said axis (58).

8. A machine as claimed in claim 7, characterized in that said control means (59) are cam control means.

9. A machine as claimed in claim 8, characterized in that said cam control means (59) comprise at least two fixed cams (63) extending along said packing path (P1); and a pair of tappet rollers (64), each of which is fitted in rotary manner to said folding body (23) and is connected to a respective said fixed cam (63).

10. A machine as claimed in claim 9, characterized in that said second conveyor (55) and said fixed cams (63) are located at a lower level than said first conveyor (20); a fixed protective body (65) extending along said packing path (P1) and between said first conveyor (20) and said second conveyor (55).

11. A machine as claimed in claim 4, characterized by also comprising gumming means (26) for depositing gum between said first lateral wing (11) and the respective said second lateral wings (13).

12. A machine as claimed in claim 4, characterized by comprising at least two said folding bodies (23), each of which folds at least a respective second lateral wing (13) and a respective first lateral wing (11); said two folding bodies (23) being respectively located at the front and rear of said assembly (8) in a traveling direction (40) along said packing path (P1).

* * * * *